US009824638B2

(12) United States Patent
Kwon et al.

(10) Patent No.: US 9,824,638 B2
(45) Date of Patent: Nov. 21, 2017

(54) DISPLAY DEVICE CAPABLE OF REDUCING POWER CONSUMPTION

(71) Applicant: Samsung Display Co., Ltd., Yongin-Si, Gyeonggi-Do (KR)

(72) Inventors: Yong-hoon Kwon, Hwaseong-si (KR); Junghyun Kim, Seoul (KR); Seokhyun Nam, Seoul (KR); Hee-kwang Song, Suwon-si (KR); Ho-sik Shin, Gyeonggi-do (KR)

(73) Assignee: Samsung Display Co., Ltd. (KR)

( * ) Notice: Subject to any disclaimer, the term of this patent is extended or adjusted under 35 U.S.C. 154(b) by 55 days.

(21) Appl. No.: 14/858,962

(22) Filed: Sep. 18, 2015

(65) Prior Publication Data

US 2016/0203771 A1 Jul. 14, 2016

(30) Foreign Application Priority Data

Jan. 14, 2015 (KR) ..... 10-2015-0006707

(51) Int. Cl.
*G09G 5/10* (2006.01)
*G09G 3/34* (2006.01)

(52) U.S. Cl.
CPC ..... *G09G 3/3413* (2013.01); *G09G 3/3426* (2013.01); *G09G 2320/064* (2013.01); *G09G 2320/0646* (2013.01); *G09G 2330/021* (2013.01); *G09G 2360/16* (2013.01)

(58) Field of Classification Search
USPC ..... 345/691
See application file for complete search history.

(56) References Cited

U.S. PATENT DOCUMENTS

| | | | | |
|---|---|---|---|---|
| 8,733,960 | B2 | 5/2014 | Seetzen et al. | |
| 2012/0194578 | A1 | 8/2012 | Znamenskiy et al. | |
| 2012/0287148 | A1 | 11/2012 | Brown Elliott | |
| 2012/0287168 | A1* | 11/2012 | Botzas | G09G 3/3413 345/690 |
| 2013/0241835 | A1 | 9/2013 | Lee | |
| 2014/0118424 | A1 | 5/2014 | Young | |
| 2015/0206507 | A1 | 7/2015 | Kwon et al. | |

FOREIGN PATENT DOCUMENTS

KR 10-2015-0087625 7/2015

* cited by examiner

*Primary Examiner* — Gustavo Polo
(74) *Attorney, Agent, or Firm* — Innovation Counsel LLP

(57) ABSTRACT

A display device including a display panel, a timing controller, a backlight unit, and a backlight controller. The display panel includes a plurality of display blocks, and receives an image signal and display an image. The backlight unit includes a-numbered red light sources, b-numbered green light sources (a and b are natural numbers, b<a), and a-numbered blue light sources, and provides light to the display panel. The backlight controller calculates a red luminance average, a green luminance average, and a blue luminance average of the block image signals, respectively, controls a duty ratio of the red light sources based on the red and green luminance averages, controls a duty ratio of the green light sources based on the green luminance average, and controls a duty ratio of the blue light sources based on the blue and green luminance averages.

19 Claims, 9 Drawing Sheets

DISPLAY DEVICE CAPABLE OF REDUCING POWER CONSUMPTION

CROSS-REFERENCE TO RELATED APPLICATIONS

A claim for priority under 35 U.S.C. §119 is made to Korean Patent Application No. 10-2015-0006707 filed Jan. 14, 2015, in the Korean Intellectual Property Office, the entire contents of which are hereby incorporated by reference.

BACKGROUND

The inventive concepts described herein relate to a display device, and more particularly, relate to a display device capable of reducing power consumption.

A liquid crystal display device typically includes a liquid crystal display panel to display an image by altering optical transmittance of liquid crystals, and a backlight unit to supply light to the liquid crystal display panel. The backlight unit basically includes a light source to provide light to the liquid crystal display panel.

In recent years, there has been developed a local dimming drive method enhancing a contrast ratio (CR) of an image, dividing a light source into a plurality of light source blocks in order to minimize power consumption, and controlling quantity of light from the light source blocks in correspondence with luminance of images corresponding to the light source blocks.

SUMMARY

One aspect according to embodiments of the inventive concept is directed to a display device drivable with lower power consumption.

In an embodiment, a display device may include a display panel, a timing controller, a backlight unit, and a backlight controller. The display panel may include a plurality of display blocks, and receive an image signal and display an image. The timing controller may receive the image signal that includes block image signals corresponding of the display blocks, respectively. The backlight unit may include a-numbered red light sources, b-numbered green light sources (a and b are natural numbers, b<a), and a-numbered blue light sources, and provide light to the display panel. The backlight controller may calculate a red luminance average, a green luminance average, and a blue luminance average of the block image signals, respectively, control a duty ratio of the red light sources based on the red and green luminance averages, control a duty ratio of the green light sources based on the green luminance average, and control a duty ratio of the blue light sources based on the blue and green luminance averages.

The backlight controller may include a first duty decider and a dimming signal generator. The first duty decider may decide a first red duty, a first green duty, and a first blue duty respectively from the red, green, and blue luminance averages. The dimming signal generator may generate a red dimming signal, which is configured to be provided to the red light sources, based on the first green duty, generate a green dimming signal, which is configured to be provided to the green light sources, based on the first green duty, and generate a blue dimming signal, which is configured to be provided to the blue light sources, based on the first blue and green duties.

The backlight unit may include a plurality of first light source blocks that correspond to the display blocks.

A number of the display blocks may be m, a number of the first light source blocks may be l, and each of the first light source blocks may include n-numbered second light source blocks (m, l, and n are natural numbers, m=l×n).

Each of the second light source blocks may include a red light source and a blue light source, and one of the n-numbered second light source blocks adjacent each other may include a green light source.

The backlight controller may further include a maximum green duty decider and a second duty decider. The maximum green duty decider may decide the maximum green duty based on the green luminance average. The second duty decider may decide a second red duty and a second blue duty respectively based on the first red and blue duties. The dimming signal generator may generate a red dimming signal, which is provided to the red light sources, based on the second red duty, generate a green dimming signal, which is provided to the green light sources, based on the maximum green duty, and generate a blue dimming signal, which is provided to the blue light sources, based on the second blue duty.

The maximum green duty decider may select the maximum value from green luminance averages of the n-numbered second light source blocks adjacent to each other.

The backlight controller may further include a first operator generator. The first operator generator may generate a first operator based on the first green duty and the maximum green duty. The first operator generator may decide the first operator by Equation 1 given as follows.

$$\text{The first operator} = \text{The first green duty} / \text{The maximum green duty} \quad \text{[Equation 1]}$$

The second duty decider may decide the second red duty by Equation 2 given as follows.

$$\text{The second red duty} = \text{The first red duty} \times \text{The first operator} \quad \text{[Equation 2]}$$

The second duty decider may decide the second blue duty by Equation 1 given as follows.

$$\text{The second blue duty} = \text{The first blue duty} \times \text{The first operator} \quad \text{[Equation 3]}$$

The dimming signal generator may generate the red dimming signal based on the second red duty, generate the green dimming signal based on the maximum green duty, and generate the blue dimming signal based on the second blue duty. The dimming signal generator may provide the red and blue dimming signals to the respective second light source blocks, and provide the green dimming signal to the respective first light source blocks.

The backlight unit may further include b-numbered cyan light sources. The backlight controller may further control a duty ratio of the cyan light sources based on the red, green, and blue luminance averages.

Each of the second light source blocks may include a red light source and a blue light source, one of the n-numbered second light source blocks adjacent to each other may include a green light source, and one of the rest of the second light source blocks may include a cyan light source.

The backlight controller may further include a maximum green duty decider, a second duty decider, and a first cyan duty decider. The maximum green duty decider may decide the maximum green duty based on the green luminance average. The second duty decider may decide a second red duty and a second blue duty respectively based on the first red and blue duties. The first cyan duty decider configured to decide a first cyan duty based on the first red and blue duties. The maximum green duty decider may select the maximum value of green luminance averages of the n-numbered second light source blocks adjacent to each other, and decide the maximum green duty based on the maximum green luminance average. The first cyan duty decider may compare the first red duty to the first blue duty, and decide a larger one of the first red and blue duties as the first cyan duty.

The backlight controller may further include a first operator generator. The first operator generator may generate a first operator based on the first green duty and the maximum green duty. The first operator generator may decide the first operator by Equation 4 given as follows.

The first operator=The first green duty/The maximum green duty [Equation 4]

The second duty decider may decide the second red duty by Equation 5 given as follows.

The second red duty=The first red duty×The first operator, [Equation 5]

The second duty decider may decide the second blue duty by Equation 6 given as follows.

The second blue duty=The first blue duty×The first operator [Equation 6]

The backlight controller may further include a second operator generator. The second operator generator may count the number of pixels expressing cyan and generate the second operator.

The second operator generator may decide the second operator by Equation 7 given as follows.

The second operator=$X/Y$ [Equation 7]

In Equation 7, X is the number of pixels, which express cyan, among pixels belonging respectively to the second light source blocks.

In Equation 7, Y is the number of pixels belonging respectively to the second light source blocks.

The backlight controller may further include a final duty decider to decide a final red duty, a final green duty, a final blue duty, and a final cyan duty from the second red duty, the second operator, the second blue duty, and the first cyan duty.

The final duty decider is configured to decide the final red duty by Equation 8 given as follows.

The final red duty=The second red duty×(1−The second operator) [Equation 8]

The final duty decider may decide the final green duty by Equation 9 given as follows.

The final green duty=The maximum green duty×(1−The second operator) [Equation 9]

The final duty decider may decide the final blue duty by Equation 10 given as follows.

The final blue duty=The second blue duty×(1−The second operator) [Equation 10]

The final duty decider may decide the final green duty by Equation 11 given as follows.

The final cyan duty=The maximum cyan duty×The second operator [Equation 11]

The dimming signal generator may generate the red dimming signal based on the final red duty, generate the green dimming signal based on the final green duty, generate the blue dimming signal based on the final blue duty, and generate the cyan dimming signal based on the final green duty. The dimming signal generator may provide the red and blue dimming signals to the respective second light source blocks; and provide the green and cyan dimming signals to the respective first light source blocks.

A display device according to an embodiment of the inventive concept may be driven in lower power consumption.

DETAILED DESCRIPTION

Figure 1:
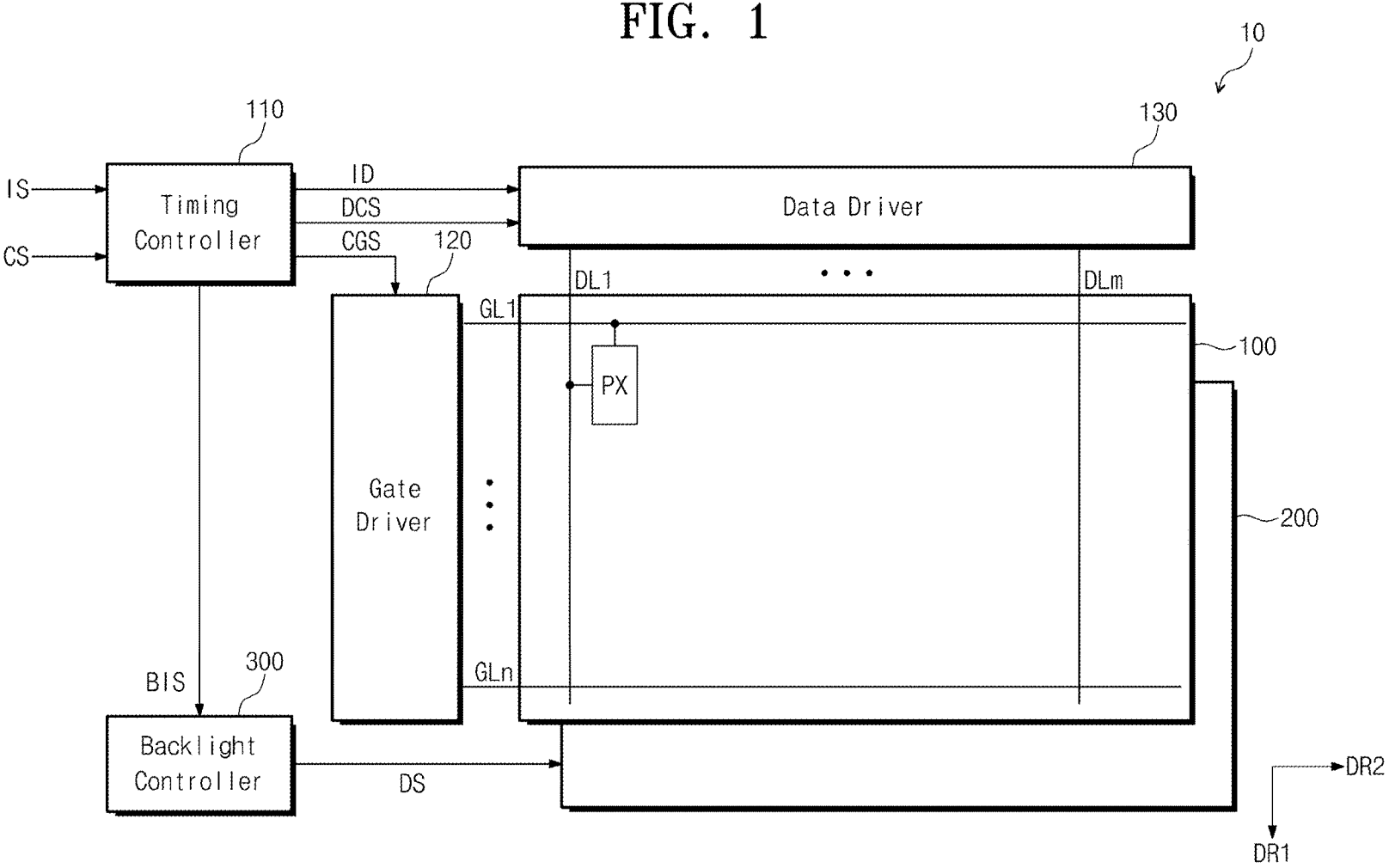
FIG. 1 is a block diagram illustrating a display device according to an embodiment of the inventive concept.

Advantages and features of the inventive concept, and ways for accomplishing them will be apparent from embodiments described in detail hereinafter in conjunction with the accompanied drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art.

Throughout the drawings, the same elements will be referred to the same reference numerals. Further in the accompanied drawings, it will be comprehended that dimensions of structural materials are magnified larger than the practical views for the sake of clarifying embodiments of the inventive concept. It will be also understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer, or section from another element, component, region, layer or section. Thus, a first element, component, region, layer, or section discussed below could be termed a second element, component, region, layer or section without departing from the teachings of the inventive concept. Even singular terms may be construed as including its plural terms unless there is any other definition or teaching in the context.

In specification, the terms "comprise", "include", or "have" will be used herein to describe not excluding the probability of existence or addition of one or more characteristics, numerals, steps, operations, elements, partial components, or combinations thereof, but including characteristics, numerals, steps, operations, elements, components, or combinations thereof, which are mentioned herein. Additionally, when one element (a layer, a film, an area or region, or a plate) is referred to as being "on" another element (another layer, another film, another area or another region, or another plate), an intervening element may be present between the one element and the another element as well as no element may be present between the one element and the another element. When an element (a layer, a film, an area or region, or a plate) is referred to as being "under" another element, the element may be directly under the another element or an intervening element may be existed between the element and the another element as well the element may be directly under the another element.

Hereinafter exemplary embodiments of the inventive concept will be described in conjunction with accompanying drawings.

FIG. 1 is a block diagram illustrating a display device according to an embodiment of the inventive concept.

Referring FIG. 1, the display device 10 may include a display panel 100, a timing controller 110, a gate driver 120, a data driver 130, a backlight unit 200, and a backlight controller 300.

The timing controller 110 may control the gate driver 120, the data driver 130 and the backlight controller 300 to be driven. The timing controller 110 may receive an image signal IS and a plurality of control signals CS from an external device. The timing controller 110 may convert the image signal IS in data format suitable for the data driver 130, generate image data ID, and then provide the image data ID to the data driver 130.

The timing controller 110 may generate data control signals DCS (e.g. output start signal, horizontal start signal, etc.) and gate control signals GCS (e.g. vertical start signal, vertical clock signal, and vertical clock-bar signal) using the control signals CS. The data control signals DCS may be provided to the data driver 130 and the gate control signals GCS may be provided to the gate driver 120. The timing controller 300 may generate block image signals BIS using the image signal IS and the control signal CS.

The gate driver 120 may drive the display panel 100. The gate driver 120 may sequentially output gate signals (not shown) in response to the gate control signals GCS which are provided from the timing controller 110.

The data driver 130 may drive the display panel 100. The data driver 130 may convert the image data ID into data voltages (not shown) and output the data voltages in response to the data control signals which are provided from the timing controller 110. The data voltages output from the data driver 130 may be applied to the display panel 100.

The display panel 100 may display an image. The display panel 100 may include a plurality of gate lines GL1~GLn, a plurality of data lines DL1~DLm, and a plurality of pixels PXs.

A plurality of the gate lines GL1~GLn may extend toward a second direction DR2 and may be arranged in parallel each other along a first direction DR1 that is vertical to the second direction DR2. The gate lines GL1~GLn may be connected to the gate driver 120 to receive the gate signals from the gate driver 120.

A plurality of the data lines DL1~DLm may extend toward the first direction DR1 and may be arranged in parallel each other along the second direction DR2. The data lines DL1~DLm may be connected to the data driver 130 to receive the data voltages from the data driver 130.

The pixels PXs may be driven in connection with a correspondent of the gate lines GL1~GLn and a correspondent of the data lines DL1~DLm. The pixels PXs will be more detailed later.

The backlight controller 300 may generate a dimming signal DS with block image signals BIS which are provided from the timing controller 110. The backlight controller 300 may provide the dimming signal DS to the backlight unit 200. The backlight controller 300 will be described in detail later.

Figure 3A:
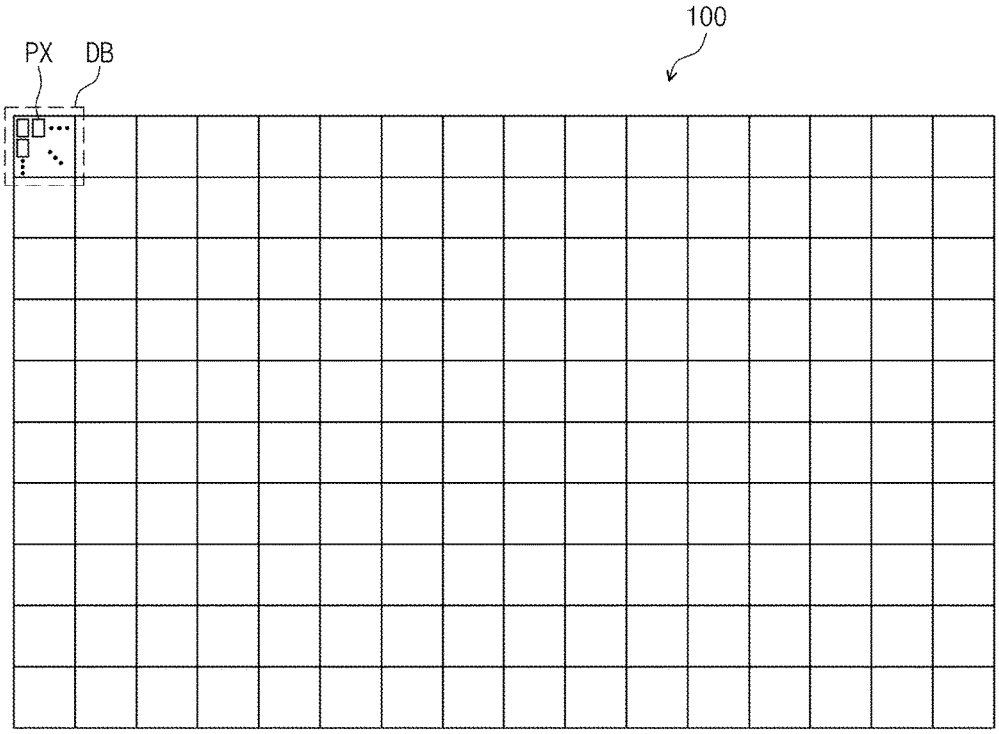
FIG. 3A is a plan diagram schematically illustrating a display panel included in a display device according to embodiment of the inventive concept.
Figure 3B:
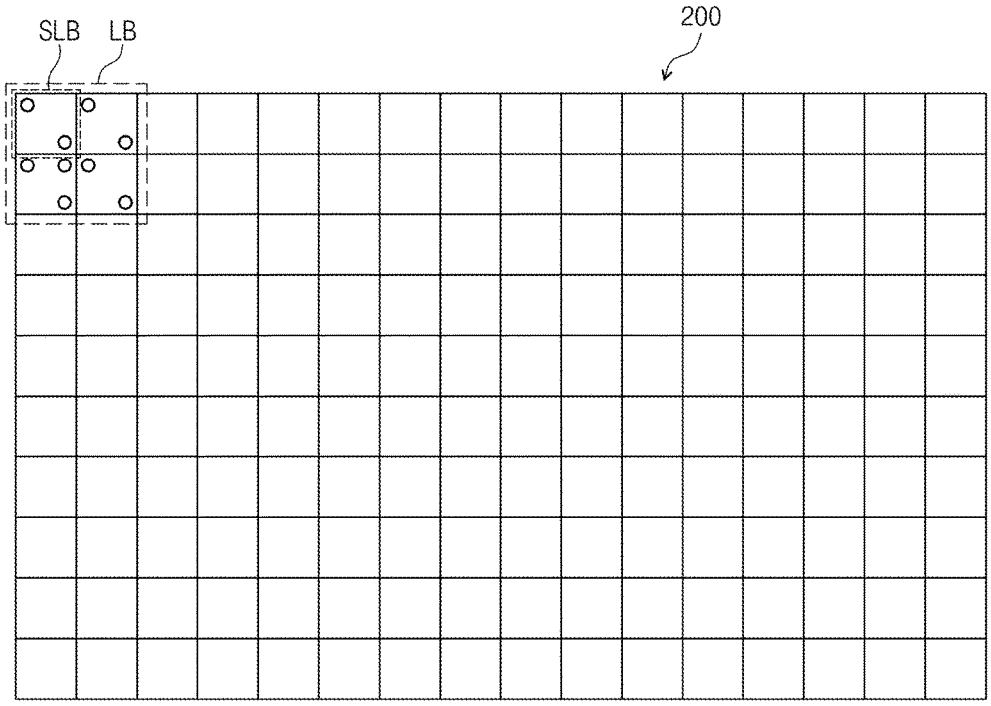
FIGS. 3B and 3C are plan diagrams schematically illustrating backlight units included in display devices according to embodiments of the inventive concept.

The backlight unit 200 may include first light source block (LB of FIG. 3B). The first light source block (LB of FIG. 3B) may include second light source blocks (SLB of FIG. 3B). The backlight unit 200 may generate light in response to the dimming signal DS and provide the light to the display panel 100. The backlight unit 200 will be described in detail later.

Figure 2:
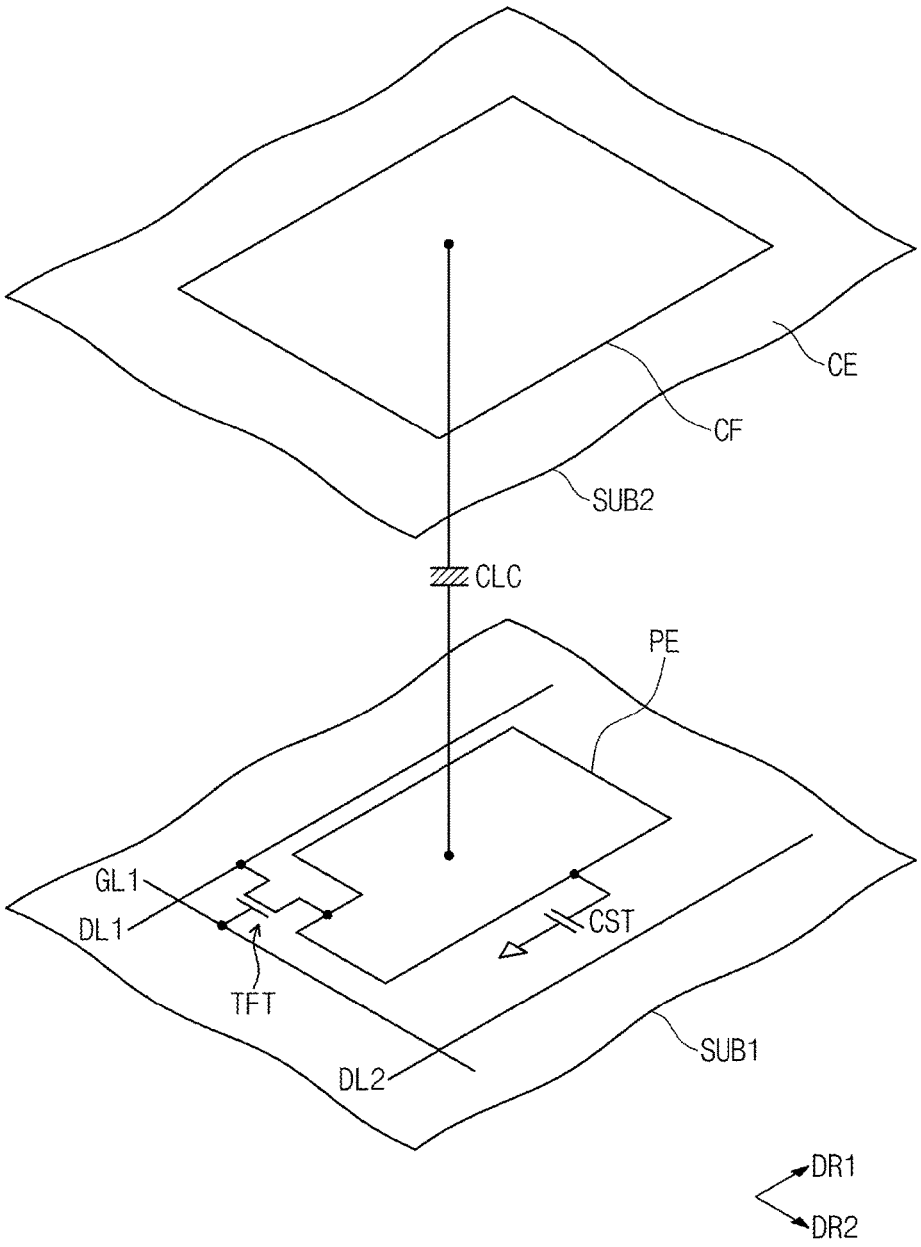
FIG. 2 is a circuit diagram schematically illustrating one of pixels included in a display device according to an embodiment of the inventive concept.

FIG. 2 is a circuit diagram schematically illustrating one of pixels included in a display device according to an embodiment of the inventive concept.

Referring to FIG. 2, a display panel 100 may include a first substrate SUB1, a second substrate SUB2, and a liquid crystal layer (not shown) interposed between the first and second substrates SUB1 and SUB2.

Although not shown, pixels PXs may include a red subpixel, a green subpixel, and a blue subpixel. However, it may not be limited hereto and pixels PXs may further include a white subpixel.

Each pixel PX may include a thin film transistor TFT connected to the first gate line GL1 and the first data line DL1, a liquid crystal capacitor CLC connected to the thin film transistor TFT, and a storage capacitor CST connected in parallel with the liquid crystal capacitor. The storage capacitor CST may be omitted according to operation conditions of the display panel 100, for example, operation frequencies.

The thin film transistor TFT may be disposed on the first substrate SUB1. The thin film transistor TFT may include a gate electrode connected to the first gate line GL1, a source electrode connected to the first data line DL1, and a drain electrode connected to the liquid crystal capacitor CLC (not shown) and the storage capacitor CST.

The liquid crystal capacitor CLC may include a pixel electrode PE disposed on the first substrate SUB1, a common electrode CE disposed on the second substrate SUB2, and a liquid crystal layer (not shown) interposed between the pixel electrode PE and the common electrode CE. In this configuration, the liquid crystal layer (not shown) may act as a dielectric of the liquid crystal capacitor CLC. The pixel electrode PE may be connected to the drain electrode of the thin film transistor TFT.

The common electrode CE may be disposed on the second substrate SUB2. However, it may not be limited hereto and rather the common electrode CE may be disposed on the first substrate SUB1. At least one of the pixel electrode PE and the common electrode CE may include a slit.

The storage capacitor CST may include the pixel electrode PE, a storage electrode (not shown) branching out from a storage line (not shown), and an insulation layer (not shown) interposed between the pixel electrode PE and the storage electrode (not shown). The storage line (not shown) may be disposed on the first substrate SUB1 and formed at the same layer with the first gate line GL1 at the same time. The storage electrode (not shown) may partly overlap the pixel electrode PE.

Each pixel PX may include a color filer CF that express one of primary colors. Although FIG. 2 is illustrated as the color filer CF is provided to the second substrate SUB2, it may not be limited hereto and the color filter CF may be disposed on the first substrate SUB1.

The thin film transistor TFT may be turned on in response to the gate signal that is provided from the first gate line GL1. The data voltage received through the first data line DL1 may be supplied to the pixel electrode PE of the liquid crystal capacitor CLC by way of the thin film transistor TFT that is turned on. A common voltage may be applied to the common electrode CE.

A voltage difference between the data voltage and the common voltage may form an electric field between the pixel electrode PE and the common electrode CE. The electric field formed between the pixel electrode PE and the common electrode CE may activate liquid crystal molecules of the liquid crystal layer (not shown). The liquid crystal molecules activated by the electric field may decide optical transmittance of the display panel thus the display panel may display an image.

A storage voltage may be applied with a constant level to the storage line (not shown). But it may not be limited hereto and a common voltage may be applied to the storage line (not shown). The storage capacitor CST may act to maintain a voltage which is charged in the liquid crystal capacitor CLC.

FIG. 3A is a plan diagram schematically illustrating a display panel included in a display device according to embodiment of the inventive concept.

Figure 3C:
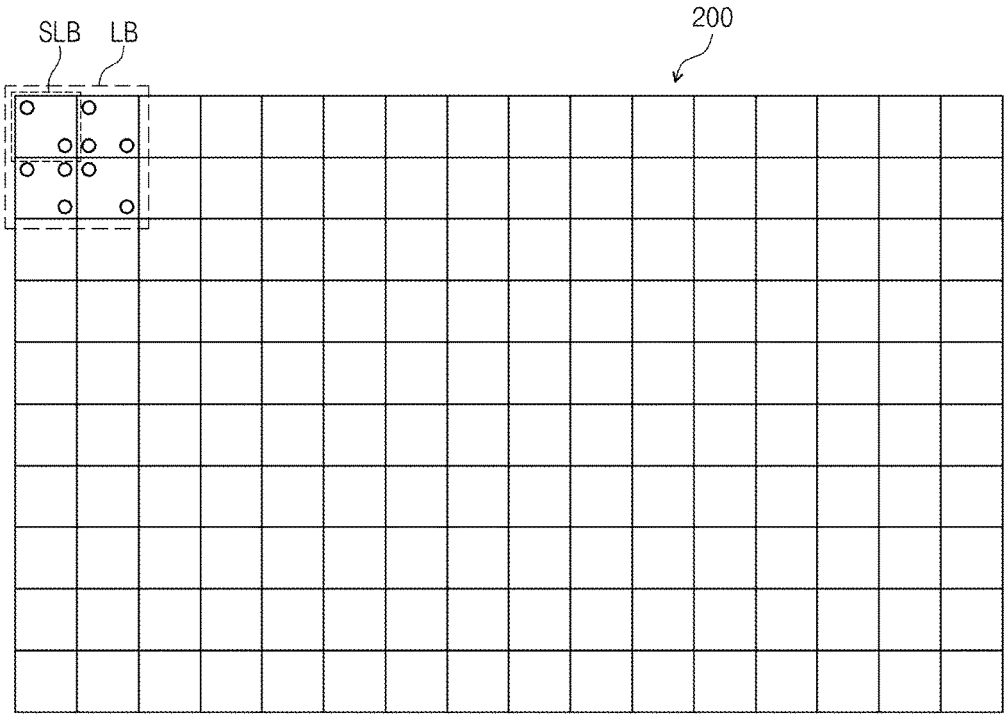

FIGS. 3B and 3C are plan diagrams schematically illustrating backlight units included in display devices according to embodiments of the inventive concept.

Figure 4A:
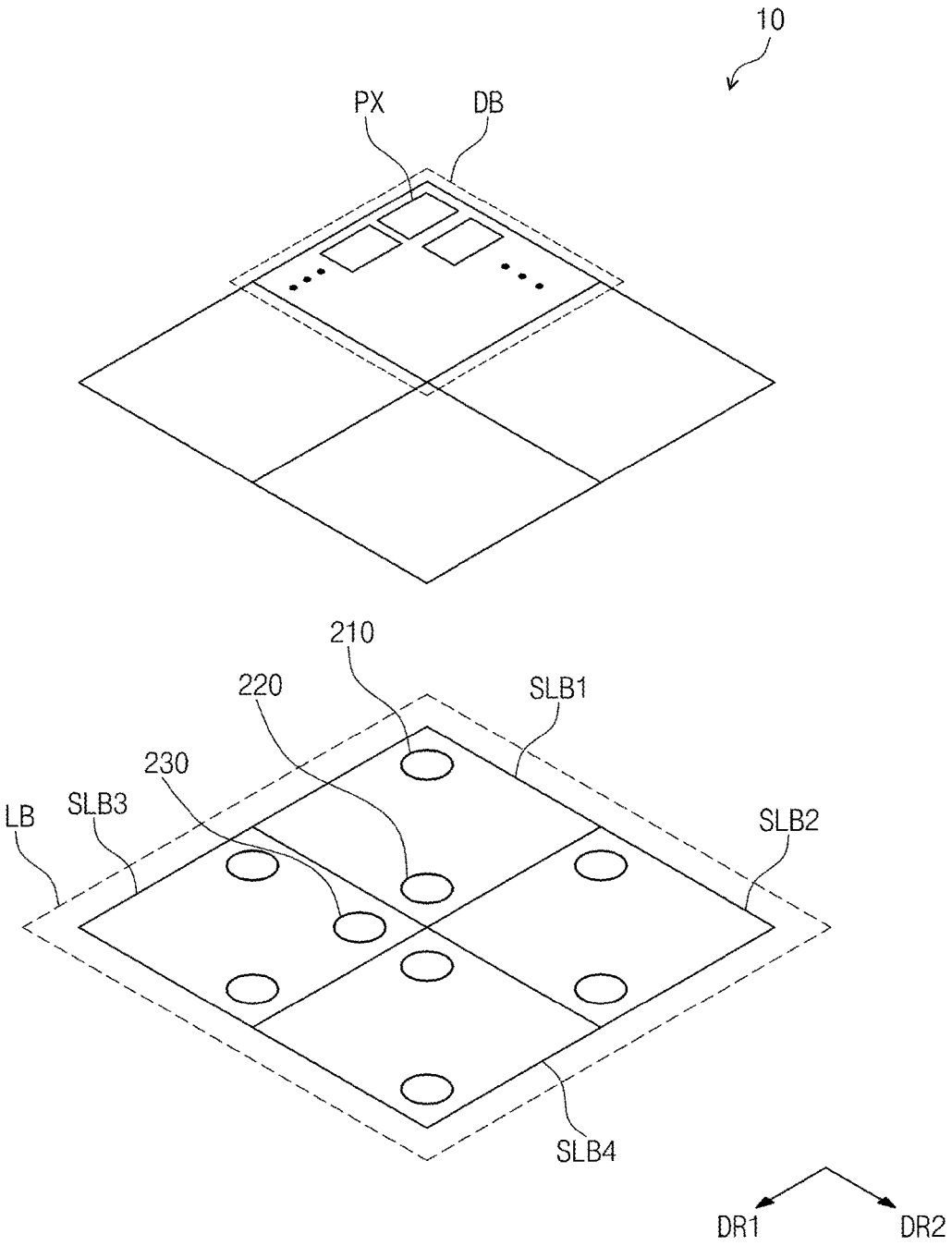
FIGS. 4A and 4B are plan diagrams schematically illustrating display panels and backlight units, which are included in display devices, according to embodiments of the inventive concept.
Figure 4B:
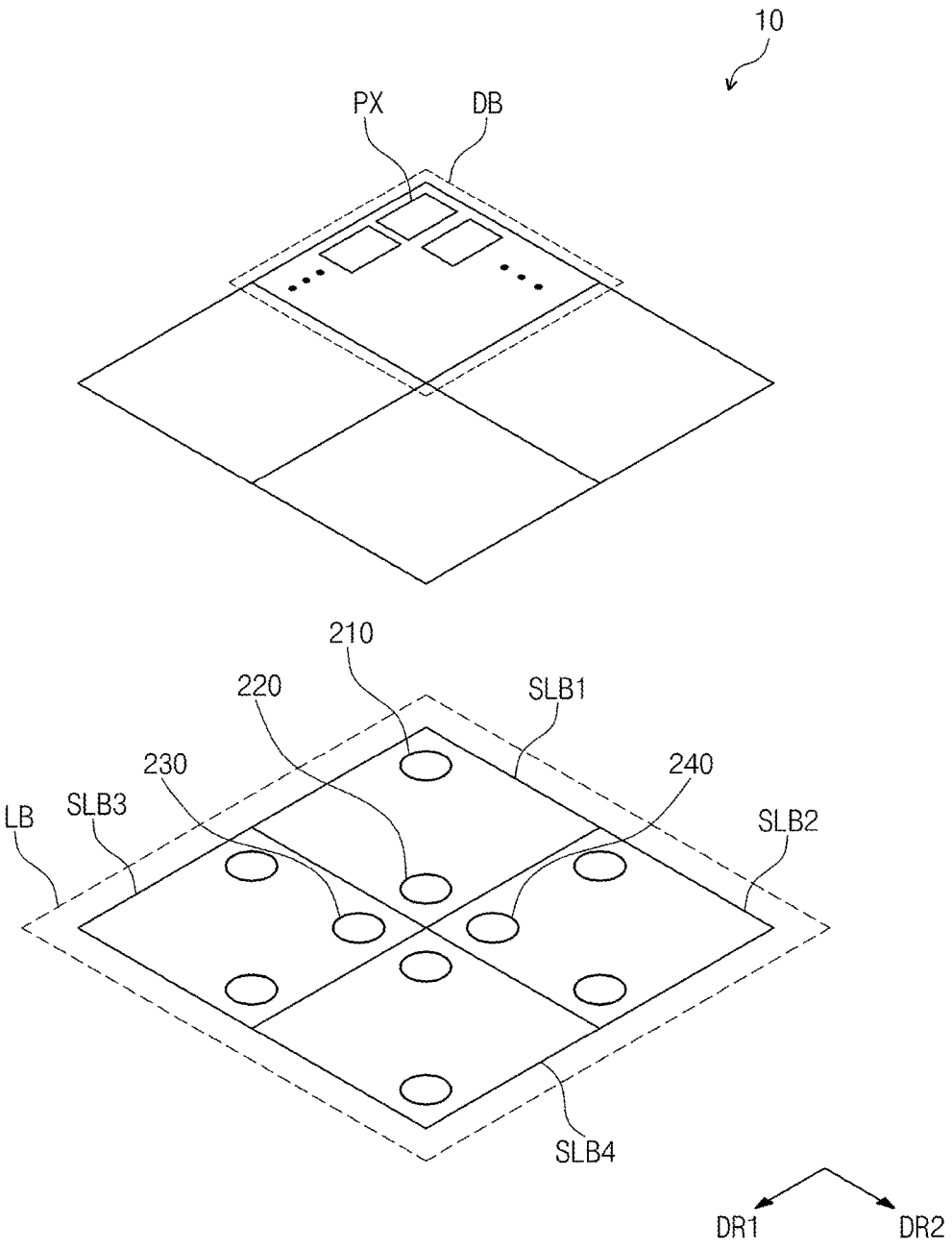

FIGS. 4A and 4B are plan diagrams schematically illustrating display panels and backlight units, which are included in display devices, according to embodiments of the inventive concept.

Referring to FIGS. 3A, 3B and 4A, a display panel 100 may include a plurality of display blocks DB. The display blocks DB may be m blocks (m is a natural number), for example 160. The number of the display blocks DB of the display panel 100 may be varied in accordance with the number of the first light source blocks LB.

As aforementioned, the backlight unit 200 may include the first light source blocks LB. The first light source blocks may be l blocks (l is a natural number), for example 40. Each of the first light source blocks LB may include n second light source blocks SLB (n is a natural number). For instance, each of the first light source blocks LB may include four second light source blocks SLB. Each of the display blocks DB may correspond to each of the second light source blocks SLB, respectively. For instance, if the display blocks DB are 160, the first light source blocks LB may be 40 and the second light source blocks SLB are 160.

As aforementioned, each of the first light source blocks LB may include the second light source blocks SLB that numbers n (n is a natural number). Hereinafter the first light source blocks LB will be described as including four second light source blocks SLB. Each of the first light source blocks LB may include a first sub light source block SLB1, a second sub light source block SLB2, a third sub light source blocks SLB3, and a fourth sub light source block SLB4, all of which are adjacent each other. The second sub light source block SLB may adjacent to the first sub light source block SLB1 in the second direction DR2. The third sub light source block SLB3 may adjacent to the first sub light source block SLB1 in the first direction DR1. The fourth sub light source block SLB4 may adjacent to the third sub light source block SLB3 in the second direction DR2 and connected with the second sub light source block SLB2 in the first direction DR1.

The first light source blocks LB may include a numbers of red light sources 210, b numbers of green light sources 230 (a and b are independently natural numbers, b<a), and a numbers of blue light sources 220. Referring to FIGS. 3C and 4B, the first light source blocks LB may further include b numbers of cyan light sources 240. For instance, the red light sources 210 may be 160, the blue light sources 220 may be 160, the green light sources may be 40, and the cyan light sources 240 may be 40.

Referring again to FIGS. 3A, 3B and 4A, each of the first sub light source SLB1, the second sub light source block SLB2, the third sub light source block SLB3, and the fourth sub light source block SLB may include red and blue light sources. Hereinafter, an embodiment will be described as for a configuration where each of the first sub light source SLB1, the second sub light source block SLB2, the third sub light source block SLB3, and the fourth sub light source block SLB includes red and blue light sources, whereas the numbers of the red and blue light sources comprised in each of the first sub light source SLB1, the second sub light source block SLB2, the third sub light source block SLB3, and the fourth sub light source block SLB may be varied. The third sub light source block SLB3 may further include a green light source.

Referring to FIGS. 3C and 4B, the second sub light source SLB2 may further include a cyan light source and the third sub light source block SLB3 may further include a green light source. However, it may not be limited hereto. The third sub light source block SLB3 may include a cyan light source and the second sub light source SLB2 may include a green light source. Otherwise, if the green light sources 230 and the cyan light sources 240 are arranged respectively with numbers smaller than those of the red light sources 210 and the blue light sources 220 in the first light source blocks LB, the red light sources 210, the green light sources 230, the blue light sources 220 and the cyan light sources 240 may be disposed in various forms.

Figure 5A:
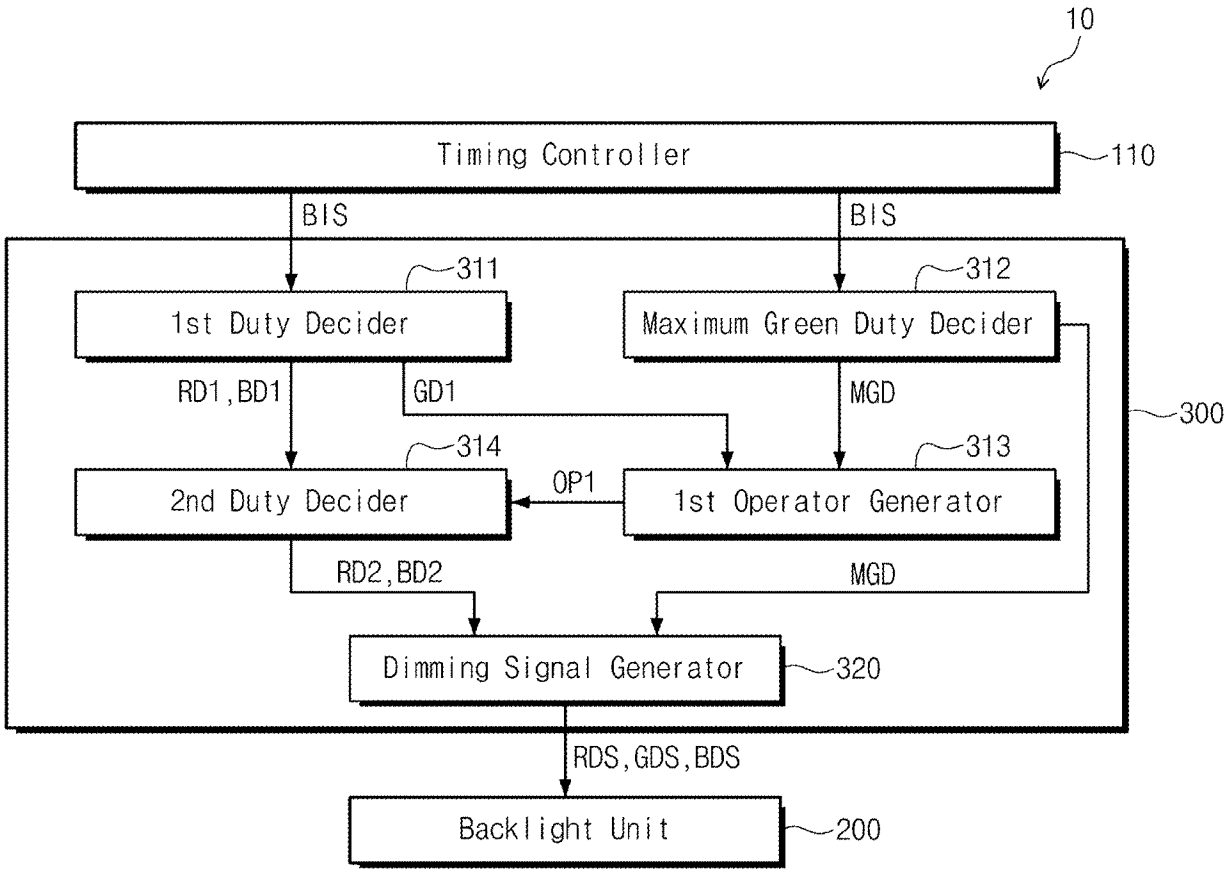
FIGS. 5A and 5B are block diagrams display devices according to embodiments of the inventive concept.
Figure 5B:
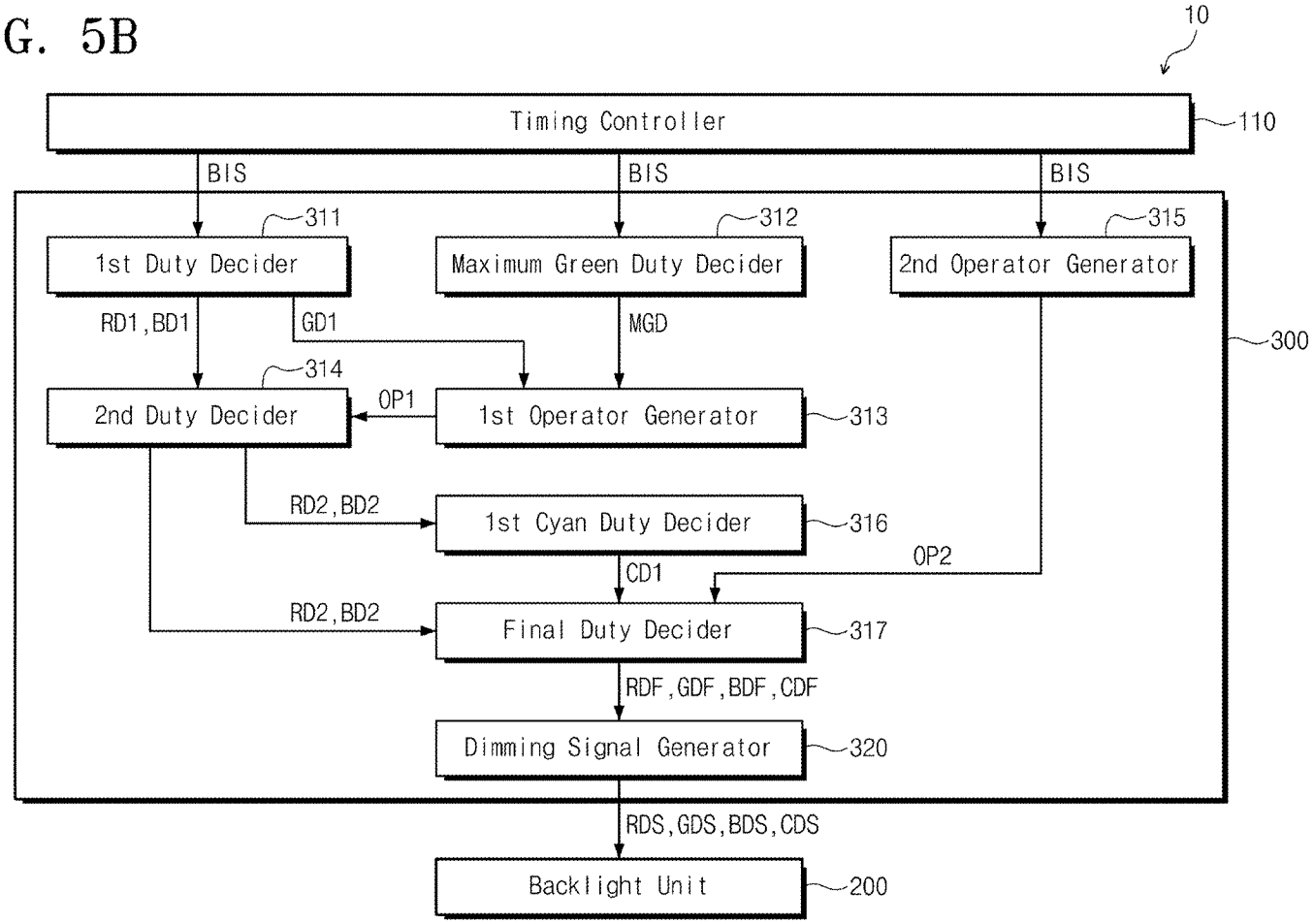

FIGS. 5A and 5B are block diagrams of display devices according to embodiments of the inventive concept.

Referring to FIGS. 1, 3A, 3B, 4A and 5A, the backlight controller 300 may calculate a red luminance average, a green luminance average, and a blue luminance average of the block image signals BIS, respectively, control a duty ratio of the red light sources 210 based on the red and green luminance averages, control a duty ratio of the green light sources based on the green luminance average, and control a duty ratio of the blue light sources 220 base on the blue and green luminance averages. Hereinafter, an embodiment will be described as the backlight controller 300 calculates the red, green, and blue luminance averages of the block image signals BIS, respectively, whereas it may not be limited hereto. Rather, the backlight controller 300 may even calculate red, green, and blue gray scale averages of the block image signals BIS, respectively, and then control duty ratios of the red, green, and blue light sources 210, 230 and 220.

The backlight controller 330 may include a first duty decider 311, a maximum green duty decider 312, a first operator generator 313, a second duty decider 314, and a dimming signal generator 320. For ease of description, while the first duty decider 311, the maximum green duty decider 312, the first operator decider 313, the second duty decider 314 and the dimming signal generator 320 will be hereinafter described as being separated individually, two or more selected from the first duty decider 311, the maximum green duty decider 312, the first operator decider 313, the second duty decider 314 and the dimming signal generator 320 may be integrated in a single component. For instance, the first duty decider 311 and the maximum green duty decider 312 may be integrated in a single component.

The first duty decider 311 may calculate red, green, and blue luminance averages of the block image signals BIS, respectively. Based on the red, green, and blue luminance averages, the first duty decider 311 may calculate a first red duty RD1, a first green duty GD1, and a first blue duty BD1, respectively.

The first duty decider 311 may store a first lookup table (not shown) which stores the first red duty RD1, the first green duty GD1, and the first blue duty BD1 corresponding to the red luminance average, the green luminance average, and the blue luminance average, respectively. The first duty decider 311 may decide the first red duty RD1, the first green duty GD1, and the first blue duty BD1.

The first duty decider 311 may provide the first red duty RD1 and the first blue duty BD1 to the second duty decider 314. The first duty decider 311 may provide the first green duty GD1 to the first operator generator 313.

The maximum green duty decider 312 may calculate the green luminance averages of the block image signals BIS, respectively. The maximum green duty decider 312 may receive the green luminance averages of the block image signals BIS from the first duty decider. The maximum green duty decider 312 may decide a maximum green duty MGD from the green luminance averages. The maximum green duty decider 312 may select the maximum value of the green luminance averages of the n-numbered second light source blocks SLB adjacent each other, and then decide the maximum green duty MGD from the maximum green luminance average.

The maximum green duty decider 312 may, for example, include a second lookup table (not shown) which stores the maximum green duty MGD corresponding to the maximum green luminance. The maximum green duty decider 312 may decide the maximum green duty MGD from the second lookup table (not shown).

The maximum green duty decider 312 may provide the maximum green duty MGD to the first operator generator 313. The maximum green duty decider 312 may provide the maximum green duty MGD to the dimming signal generator 320.

The first operator generator 313 may provide the first green duty GD1 and the maximum green duty MGD. The first operator generator 313 may generate a first operator OP1 using the first green duty GD1 and the maximum green duty MGD. The first operator generator 313 may provide the first operator OP1 to the second duty decider 314.

The first operator generator 313 may operate to decide the first operator OP1 by Equation 1 as follows.

$$\text{The first operator } OP1 = \text{The first green duty GD1} / \text{The maximum duty MGD} \quad \text{[Equation 1]}$$

The second duty decider 314 may receive the first red duty RD1 and the first blue duty BD1 from the first duty decider 311. The second duty decider 314 may decide a second red duty RD2 and a second blue duty BD2 based on the first red duty RD1 and the first blue duty BD1. The second duty decider 314 may provide the second red and blue duties RD2 and BD2 to the dimming signal generator 320.

The second duty decider 314 may decide the second red duty RD2 by Equation 2 as follows.

$$\text{The second red duty RD2} = \text{the first red duty RD1} \times \text{the first operator } OP1. \quad \text{[Equation 2]}$$

The second duty decider 314 may decide the second blue duty BD2 by Equation 3 as follows.

$$\text{The second blue duty BD2} = \text{the first blue duty BD1} \times \text{the first operator } OP1. \quad \text{[Equation 3]}$$

The dimming signal generator 320 may generate a red dimming signal RDS, a green dimming signal GDS, and a blue dimming signal BDS. The dimming signal generator 320 may output the red dimming signal RDS, which is provided to the red light sources 210, based on the first red and green duties RD1 and GD1, output the green dimming signal GDS, which is provided to the green light sources 230, based on the first green duty GD1, and output the blue dimming signal BDS, which is provided to the blue light source 220, based on the first blue and green duties BD1 and GD1.

In more detail, the dimming signal generator 320 may receive the second red duty RD2, the maximum green duty MGD, and the second blue duty BD2. The dimming signal generator 320 may generate the red dimming signal RDS, which is provided to the red light sources 210, based on the second red duty RD2, generate the green dimming signal GDS, which is provided to the green light sources 230, based on the maximum green duty MGD, and generate the blue dimming signal BDS, which is provided to the blue light sources 220, based on the second blue duty BD2.

The dimming signal generator 320 may provide the red and blue dimming signals RDS and BDS to the respective second light source blocks SLB, and provide the green dimming signal GDS to the respective first light source blocks LB.

In case of operating a local dimming mode, light quantities emitted respectively from the first light source blocks may be controlled by varying duty ratios or sizes of the red and blue dimming signals which are applied to the first light source blocks. Additionally, light quantities emitted respectively from the second light source blocks may be controlled by varying duty ratio or size of the green dimming signal which is applied to the first light source blocks. As a result, the display blocks of the display panel may be supplied with light intensities different each other. Therefore, the display device according to embodiments of the inventive concept may be driven even with lower power consumption.

Referring to FIGS. 1, 3A, 3C, 4B, and 5B, a backlight controller 300 may calculate red, green, and blue luminance averages of the block image signals BIS, respectively, control a duty ratio of the red light sources 210 based on the red and green luminance averages, control a duty ratio of the green light sources 230 based on the green luminance average, control a duty ratio of the blue light sources 220 based on the blue and green luminance averages, and control a duty ratio of the cyan light sources 240 based on the red, green, and blue luminance averages.

The backlight controller 300 may include a first duty decider 311, a maximum green duty decider 312, a first operator generator 313, a second duty decider 314, a first cyan duty decider 316, a second operator generator 315, a final duty decider 317, and a dimming signal generator 320. For ease of description, the first duty decider 311, the maximum green duty decider 312, the first operator generator 313, the second duty decider 314, the first cyan duty decider 316, the second operator generator 315, the final duty decider 317, and the dimming signal generator 320 will be described later as being separated individually. However, two or more selected from the first duty decider 311, the maximum green duty decider 312, the first operator generator 313, the second duty decider 314, the first cyan duty decider 316, the second operator generator 315, the final duty decider 317, and the dimming signal generator 320 may be integrated in a single component. For instance, the first duty decider 311 and the maximum duty decider 312 may be configured in a single component.

The first duty decider 311 may calculate red, green, and blue luminance averages of the block image signals BIS, respectively. The duty decider 311 may decide a first red duty RD1, a first green duty GD1, and a first blue duty BD1 respectively from the red, green, and blue luminance averages.

The duty decider 311 may include a first lookup table (not shown) which stores the first red, green, and blue duties RD1, GD1, and BD1 corresponding respectively to the red, green, blue luminance averages. The duty decider 311 may decide the first red, green, and blue duties RD1, GD1, and BD1 from the first lookup table (not shown).

The duty decider 311 may provide the first red and blue duties RD1 and BD1 to the second duty decider 314. The first duty decider 311 may provide the first green duty GD1 to the first operator generator 313.

The maximum green duty decider 312 may calculate green luminance averages of the block image signals BIS, respectively. The maximum green duty decider 312 may receive the green luminance averages of the block image signals BIS from the first duty decider. The maximum green duty decider 312 may decide a maximum green duty from the green luminance averages. The maximum green duty decider 312 may select the maximum value from the green luminance averages of the n-numbered second light source blocks SLB that are adjacent each other, and then decide the maximum green duty MGD from the maximum green luminance average. The maximum green duty decider 312 may provide the maximum green duty MGD to the first operator generator 313.

The maximum green duty decider 312 may for example store a second lookup table (not shown) which stores the maximum green duty MGD corresponding to the maximum green luminance average. The maximum green duty decider 312 may decide the maximum green duty from the second lookup table (not shown).

The first operator generator 313 may receive a first green duty GD1 and the maximum green duty MGD. The first operator generator 313 may generate a first operator OP1 using the first green duty GD1 and the maximum green duty MGD. The first operator generator 313 may provide the first operator OP1 to the second duty decider 314.

The first operator generator 313 may operate to decide the first operator OP1 by Equation 4 as follows.

$$\text{The first operator } OP1 = \text{The first green duty GD1} / \text{The maximum green duty MGD} \quad \text{[Equation 4]}$$

The second duty decider 314 may receive a first red duty RD1 and a first blue duty BD1 from the first duty decider 311. The second duty decider 314 may decide a second red duty RD2 and a second blue duty BD2 based on the first red and blue duties RD1 and BD1. The second duty decider 314 may provide the second red and blue duties RD2 and BD2 to the first cyan duty decider 316. The second duty decider 314 may provide the second red and blue duties RD2 and BD2 to the final duty decider 317.

The second duty decider 314 may decide the second red duty RD2 by Equation 5 as follows.

$$\text{The second red duty RD2} = \text{The first red duty RD1} \times \text{The first operator } OP1 \quad \text{[Equation 5]}$$

The second duty decider 314 may decide the second blue duty BD2 by Equation 6 as follows.

$$\text{The second blue duty BD2} = \text{The first blue duty BD1} \times \text{The first operator } OP1 \quad \text{[Equation 6]}$$

The first cyan duty decider 316 may receive the second red and blue duties RD2 and BD2 from the second duty decider 314. By comparing the second red duty RD2 to the second blue duty BD2, a large one of them may be decided as a first cyan duty CD1. The first cyan duty decider 316 may provide the first cyan duty CD1 to the final duty decider 317.

The second operator generator 315 may receive block image signals BIS, and then generate a second operator OP2 by counting the number of pixels expressing cyan in each of the light source blocks SLB. The second operator generator 315 may provide the second operator OP2 to the final duty decider 317.

The second operator generator 315 may operate to decide the second operator OP2 by Equation 7 as follows.

$$\text{The second operator } OP2 = X/Y \quad \text{[Equation 7]}$$

In Equation 7, X denotes the number of pixels, which express cyan, among pixels belonging respectively to the second light source blocks SLB.

In Equation 7, Y denotes the number of pixels belonging respectively to the second light source blocks SLB.

The final duty decider 317 may receive the second red and blue duties RD2 and BD2 from the second duty decider 314. The final duty decider 317 may receive the first cyan duty CD1 from the first cyan duty decider 316. The final duty decider 317 may receive the second operator OP2 from the second operator generator 315. The final duty decider 317 may decide a final red duty RDF, a final green duty GDF, a final blue duty BDF, and a final cyan duty CDF based on the second red duty RD2, the second operator OP2, the second blue duty BD2, and the first cyan duty CD1.

The final duty decider 317 may decide the final red duty RDF by Equation 8 as follows.

$$\text{The final red duty RDF} = \text{The second red duty RD2} \times (1 - \text{The second operator } OP2) \quad \text{[Equation 8]}$$

The final duty decider 317 may operate to decide the final green duty GDF by Equation 9 as follows.

$$\text{The final green duty GDF} = \text{The maximum green duty MGD} \times (1 - \text{The second operator } OP2) \quad \text{[Equation 9]}$$

The final duty decider 317 may operate to decide the final blue duty BDF by Equation 10 as follows.

$$\text{The final blue duty BDF} = \text{The second blue duty BD2} \times (1 - \text{The second operator } OP2) \quad \text{[Equation 10]}$$

The final duty decider 317 may operate to decide the final cyan duty CDF by Equation 11 as follows.

$$\text{The final cyan duty CDF} = \text{The first cyan duty CD1} \times \text{The second operator } OP2 \quad \text{[Equation 11]}$$

The final duty decider 317 may provide the final red duty RDF, the final green duty GDF, the final blue duty BDF, and the final cyan duty CDF to the dimming signal generator 320.

The dimming signal generator 320 may receive the final red duty RDF, the final green duty GDF, the final blue duty BDF, and the final cyan duty CDF from the final duty decider 317. The dimming signal generator 320 may output a red dimming signal RDS, a green dimming signal GDS, and a blue dimming signal BDS. The dimming signal generator 320 may output the red dimming signal RDS, which is provided to the red light sources 210, based on the first red and green duties RD1 and GD1, output the green dimming signal GDS, which is provided to the green light sources 230, based on the first green duty GD1, and output the blue dimming signal BDS, which is provided to the blue light sources 220, based on the first blue and green duties BD1 and GD1.

In more detail, the dimming signal generator 320 may output the red dimming signal RDS based on the final red duty RDF, output the green dimming signal GDS based on the final green duty GDF, output the blue dimming signal BDS based on the final blue duty BDF, and output the cyan dimming signal CDS based on the final cyan duty CDF. The dimming signal generator 320 may provide the red and green dimming signals RDS and BDS respectively to the second light source blocks SLB, and provide the green and cyan dimming signals GDS and CDS to the first light source blocks LB.

The dimming signal generator 320 may operate to provide the red and blue dimming signals RDS and BDS to the second light source blocks SLB, respectively, and provide the green and cyan dimming signals GDS and CDS to the first light source blocks LB, respectively.

In a local dimming mode, light quantities emitted respectively from the first light source blocks may be controlled by varying duty ratios or sizes respective to the red and blue dimming signals which are applied to the first light source blocks. Additionally, light quantities emitted respectively from the second light source blocks may be controlled by varying duty ratios or sizes respective to the green and cyan dimming signals which are applied to the second light source blocks. As a result, the display blocks of the display panel may be supplied with different light intensities in the unit of block. Therefore, the display device according to embodiments of the inventive concept may be driven in lower power consumption.

While the inventive concept has been described with reference to exemplary embodiments, it will be apparent to those skilled in the art that variously changes and modifications may be made without departing from the spirit and scope of the inventive concept set forth throughout the annexed claims. Therefore, it should be understood that the above embodiments are not limiting, but illustrative, hence all technical things within the annexed claims and the equivalents thereof may be construed as properly belonging to the territory of the inventive concept.

What is claimed is:

1. A display device comprising:

a display panel including a plurality of display blocks, each of the plurality of display blocks including at least two light sources, and configured to receive an image signal and display an image;

a timing controller configured to receive the image signal that includes block image signals corresponding to the display blocks, respectively;

a backlight unit including a plurality of light source blocks, each of the light source blocks including a-numbered red light sources, b-numbered green light sources (a and b are natural numbers, b<a), and a-numbered blue light sources, and configured to provide light to the display panel; and a backlight controller configured to calculate a red luminance average, a green luminance average, and a blue luminance average of the block image signals, respectively, control a duty ratio of the red light sources based on the red and green luminance averages, control a duty ratio of the green light sources based on the green luminance average, and control a duty ratio of the blue light sources base on the blue and green luminance averages.

2. The display device according to claim 1, wherein the backlight controller includes:

a first duty decider configured to decide a first red duty, a first green duty, a first blue duty respectively from the red, green, and blue luminance averages; and a dimming signal generator configured to generate a red dimming signal, which is configured to be provided to the red light sources, based on the first green duty, generate a green dimming signal, which is configured to be provided to the green light sources, based on the first green duty, and generate a blue dimming signal, which is configured to be provided to the blue light sources, based on the first blue and green duties.

3. The display device according to claim 2, wherein the backlight unit includes a plurality of first light source blocks that correspond to the display blocks.

4. The display device according to claim 3, wherein a number of the display blocks are m, wherein a number of the first light source blocks are l, wherein each of the first light source blocks includes n-numbered second light source blocks (m, l, and n are natural numbers, m=l×n).

5. The display device according to claim 4, wherein each of the second light source blocks includes a red light source and a blue light source, wherein one of the n-numbered second light source blocks adjacent each other includes a green light source.

6. The display device according to claim 4, wherein the backlight controller further includes:

a maximum green duty decider configured to decide the maximum green duty based on the green luminance average; and a second duty decider configured to decide a second red duty and a second blue duty respectively based on the first red duty and the first blue duty, wherein the dimming signal generator is configured to generate a red dimming signal, which is provided to the red light sources, based the second red duty, generate a green dimming signal, which is provided to the green light sources, based on the maximum green duty, and generate a blue dimming signal, which is provided to the blue light sources, based on the second blue duty.

7. The display device according to claim 6, wherein the maximum green duty decider is configured to select the maximum value from green luminance averages of the n-numbered second light source blocks adjacent to each other.

8. The display device according to claim 7, wherein the backlight controller further includes:

a first operator generator configured to generate a first operator based on the first green duty and the maximum green duty, wherein the first operator generator is configured to decide the first operator by an equation given in:

$$\text{the first operator} = \text{the first green duty} / \text{the maximum green duty}.$$

9. The display device according to claim 8, wherein the second duty decider is configured to decide the second red duty by an equation given in:

$$\text{the second red duty} = \text{the first red duty} \times \text{the first operator},$$

wherein the second duty decider is configured to decide the second blue duty by an equation given in:

$$\text{the second blue duty} = \text{the first blue duty} \times \text{the first operator}.$$

10. The display device according to claim 6, wherein the dimming signal generator is configured to:

generate the red dimming signal based on the second red duty;

generate the green dimming signal based on the maximum green duty;

generate the blue dimming signal based on the second blue duty;

provide the red and blue dimming signals to the respective second light source blocks; and provide the green dimming signal to the respective first light source blocks.

11. The display device according to claim 4, wherein the backlight unit further includes b-numbered cyan light sources, wherein the backlight controller is configured to further control a duty ratio of the cyan light sources based on the red, green, and blue luminance averages.

12. The display device according to claim 11, wherein each of the second light source blocks includes a red light source and a blue light source, wherein one of the n-numbered second light source blocks adjacent to each other includes a green light source, wherein one of the rest of the second light source blocks includes a cyan light source.

13. The display device according to claim 11, wherein the backlight controller further includes:

a maximum green duty decider configured to decide the maximum green duty based on the green luminance average;

a second duty decider configured to decide a second red duty and a second blue duty respectively based on the first red and blue duties; and a first cyan duty decider configured to decide a first cyan duty based on the first red and blue duties, wherein the maximum green duty decider is configured to select the maximum value of green luminance averages of the n-numbered second light source blocks adjacent to each other, and decide the maximum green duty based on the maximum green luminance average, wherein the first cyan duty decider is configured to compare the second red duty to the second blue duty, and decide a larger one of the second red and blue duties as the first cyan duty.

14. The display device according to claim 13, wherein the backlight controller further includes a first operator generator configured to generate a first operator based on the first green duty and the maximum green duty, wherein the first operator generator is configured to decide the first operator by an equation given in:

the first operator=the first green duty/the maximum green duty.

15. The display device according to claim 14, wherein the second duty decider is configured to decide the second red duty by an equation given in:

the second red duty=the first red duty×the first operator, wherein the second duty decider is configured to decide the second blue duty by an equation given in:

the second blue duty=the first blue duty×the first operator.

16. The display device according to claim 15, wherein the backlight controller further includes a second operator generator configured to count the number of pixels expressing cyan and generate the second operator, wherein the second operator generator is configured to decide the second operator by an equation given in:

the second operator=$X/Y$, where X is the number of pixels, which express cyan, among pixels belonging respectively to the second light source blocks and Y is the number of pixels belonging respectively to the second light source blocks.

17. The display device according to claim 16, wherein the backlight controller further includes a final duty decider configured to decide a final red duty, a final green duty, a final blue duty, and a final cyan duty from the second red duty, the maximum green duty, the second blue duty, and the first cyan duty.

18. The display device according to claim 17, wherein the final duty decider is configured to decide the final red duty by an equation given in:

the final red duty=the second red duty×(1−the second operator), wherein the final duty decider is configured to decide the final green duty by an equation given in:

the final green duty=the maximum green duty×(1−the second operator), wherein the final duty decider is configured to decide the final blue duty by an equation given in:

the final blue duty=the second blue duty×(1−the second operator), wherein the final duty decider is configured to decide the final green duty by an equation given in:

the final cyan duty=the maximum cyan duty×the second.

19. The display device according to claim 18, wherein the dimming signal generator is configured to:

generate the red dimming signal based on the final red duty;

generate the green dimming signal based on the final green duty;

generate the blue dimming signal based on the final blue duty;

generate the cyan dimming signal based on the final green duty;

provide the red and blue dimming signals to the respective second light source blocks; and provide the green and cyan dimming signals to the respective first light source blocks.

* * * * *